US005738346A

United States Patent [19]

Ishida

[11] Patent Number: 5,738,346

[45] Date of Patent: Apr. 14, 1998

[54] APPARATUS FOR STITCHING COLLATED SHEETS

[75] Inventor: Katsunori Ishida, Kyoto, Japan

[73] Assignee: Horizon International Inc., Shiga, Japan

[21] Appl. No.: 754,289

[22] Filed: Nov. 20, 1996

[30] Foreign Application Priority Data

Mar. 13, 1996 [JP] Japan ..... 8-097284

[51] Int. Cl.[6] ..... B65H 39/02

[52] U.S. Cl. ..... 270/58.07; 270/58.08

[58] Field of Search ..... 270/58.01, 58.07, 270/58.08

[56] References Cited

U.S. PATENT DOCUMENTS 4,552,497 11/1985 Kockler et al. ..... 270/58.08
5,348,279 9/1994 Lambregts et al. ..... 270/58.08
5,460,359 10/1995 Toyohara et al. ..... 270/58.08
5,478,062 12/1995 Horiuchi et al. ..... 270/58.08

*Primary Examiner*—John T. Kwon
*Attorney, Agent, or Firm*—Morgan & Finnegan, L.L.P.

[57] ABSTRACT

An improved apparatus for stitching collated sheets is provided. Collated sleets to be stitched are transported along a first transport path portion (29) into a sheet stitching station (80) independently of different sheet stitching patterns. After sheet stitching operation of a stitching head (31), a sheet transport path for stitched sheets is divided into two sheet transport path portions, one is a fifth transport path portion (36a) extending to a sheet eject outlet (19), the other is a third transport path portion (40) extending to a sheet bending station (38), at a branch (K) . A switching gate plate is arranged at the branch (K) so as to selectively switch the transport path portions depending on whether the bending operation is required or not. A fourth transport path portion (42) extends from the sheet bending station (38) to the sheet eject outlet (19). Thus stitched sheets are all delivered from the only one sheet eject outlet (19).

4 Claims, 4 Drawing Sheets

APPARATUS FOR STITCHING COLLATED SHEETS

BACKGROUND OF THE INVENTION

This invention relates to an apparatus for stitching collated sheets together. More particularly, the present invention relates to an apparatus for stitching together collated sheets along the center line thereof and bending the stitched sheets double along the stitched portion thereof.

The apparatus for stitching collated sheets is employed with, for example, a sheet collator. The conventional stitching apparatus is arranged to receive collated sheets from the sheet collator and stitch the collated sheets along the center line thereof and then bend the stitched sheets double along the stitched portion thereof. Such stitching apparatus is often required to have not only ability to stitch collated sheets along the center line thereof but also ability to stitch collated sheets along an end line thereof or at a corner thereof, as occasion arises. The stitching machine is, therefore, so designed that it is capable of achieving a plurality of stitching patterns of the collated sheets such as a center line stitching pattern and an end line stitching pattern and a corner stitching pattern.

SUMMARY OF THE INVENTION

This type of stitching apparatus is provided with a plurality of outlets for ejecting a set of stitched sheets. The reason for this is as follows: On performing a center line stitching, a set of stitched sheets is bent along its stitched portion after stitching, while on performing an end line stitching or a corner stitching, a set of stitched sheets is not bent. Consequently, in the stitching apparatus, an eject position of the set of sheets stitched along the center line thereof and an eject position of the set of sheets stitched along the end line or the corner thereof are different from each other.

Thus it should be carefully considered how to deliver the set of stitched sheets from the stitching apparatus to the other machine for the following process such as an edge trimmer depending on choice of sheet stitching pattern, which leads to considerably troublesome work.

An object of the invention is, therefore, to provide a new and improved stitching apparatus which is provided with a single outlet for ejecting stitched set of collated sheets so as to facilitate delivery stitched sheets to the other machine for the following process, though it has not only ability to stitch collated sheets along the center line thereof and bend the stitched sheets double along the stitched portion thereof but also ability to stitch collated sheets along an end line thereof or at a corner thereof.

Another object of the invention is to provide a new and improved stitching apparatus having a simpler and more compact sheet transport mechanism.

According to the present invention, these objects are accomplished by an apparatus for stitching collated sheets, the apparatus receiving a set of collated sheets at a sheet supply inlet thereof, transporting the collated sheets to a sheet stitching station, stitching the collated sheets along the center line thereof or along an end line or at a corner thereof by means of a stitching head disposed at the sheet stitching station, and delivering the sheets stitched along the end line or at the corner thereof from at least one sheet eject outlet thereof, while delivering the sheets stitched along the center line thereof from at least one sheet eject outlet after transport to a sheet bending station so as to bend the stitched sheets double along the center line, characterized in that the apparatus comprises: a first transport path portion for transporting the collated sheets from the sheet supply inlet to the sheet stitching station; a first stopper arranged at the sheet stitching station for positioning the sheets to be stitched along the end line or at the corner thereof; a second stopper arranged at the sheet stitching station for positioning the sheets to be stitched along the center line thereof; a second transport path portion for transporting the stitched sheets from the sheet stitching station to a branch; a fifth transport path portion for transporting the stitched sheets from the branch to a sheet eject outlet; a third transport path portion for transporting the stitched sheets from the branch to the sheet bending station; a switching gate plate arranged at the branch for selectively connecting the second transport path portion to the third transport path portion or the fifth transport path portion; a third stopper arranged at the sheet bending station for positioning the sheets stitched along the center line thereof; sheet bend means arranged at the sheet bending station for bending the stitched sheets double along the center line thereof; and a fourth transport path portion for transporting the stitched sheets bent double from the sheet bending station to the sheet eject outlet.

In accordance with a preferred embodiment, the first transport path portion, the second transport path portion and the third transport path portion are composed of a part of a single conveyor belt loop, respectively. A chute is disposed between the stitching head and the first stopper. The fourth transport path portion is composed of a clearance of a pair of fold rollers and a clearance of a pair of delivery rollers and a space between the fold roller pair and the delivery roller pair, and the fifth transport path portion is composed of an inclined guide plate downwardly extending from the branch to the sheet eject outlet.

In accordance with another preferred embodiment, the sheet eject outlet is disposed lower than the branch. The second and third transport path portions comprise a chute for gravitationally transporting stitched sheets, respectively. The first and fourth transport path portions comprise a part of a single conveyor belt loop driven by a single drive source, respectively. The fifth transport path portion is composed of an inclined guide plate downwardly extending from the branch to the sheet eject outlet.

In accordance with further preferred embodiment, the sheet bend means comprises the pair of fold rollers and a fold knife arranged oppositely to the fold roller pair with respect to the stitched sheets in such a manner that the fold knife projects its tip portion from the plane on which the stitched sheets are positioned.

Accordingly, the present invention is advantageous in that collated sheets to be stitched are transported along the first transport path portion into the sheet stitching station independently of different sheet stitching patterns, and that after sheet stitching operation, the sheet transport path for stitched sheets is divided into two sheet transport path sections, one of which extends to a sheet eject outlet, the other of which extends to a sheet bending station, at a branch and then a switching gate plate is arranged at the branch so as to selectively switch the transport path sections depending on whether the bending operation is required or not, and that a transport path section extending from the sheet bending station to the sheet eject outlet is formed, so that stitched sheets are all delivered from the only one sheet eject outlet. It is, therefore, facilitated to delivery stitched sheets to the other machine for the following process, though the apparatus has not only ability to stitch collated sheets along the center line thereof and bend the stitched sheets double along the stitched portion thereof but also ability to stitch collated sheets along an end line thereof or at a corner thereof.

Furthermore, according to another embodiment of this invention, the sheet eject outlet is disposed lower than the branch for switching the transport path sections, and the second and third transport path portions comprise a chute for gravitationally transporting stitched sheets and the first and fourth transport path portions comprise a conveyor belt loop driven by a single drive source. According to this embodiment, a simple and compact stitching apparatus can be achieved.

The other objects and features of this invention will become understood from the following description with reference to the accompanying drawings.

DETAILED DESCRIPTION OF THE PREFERRED EMBODIMENT

Figure 1:
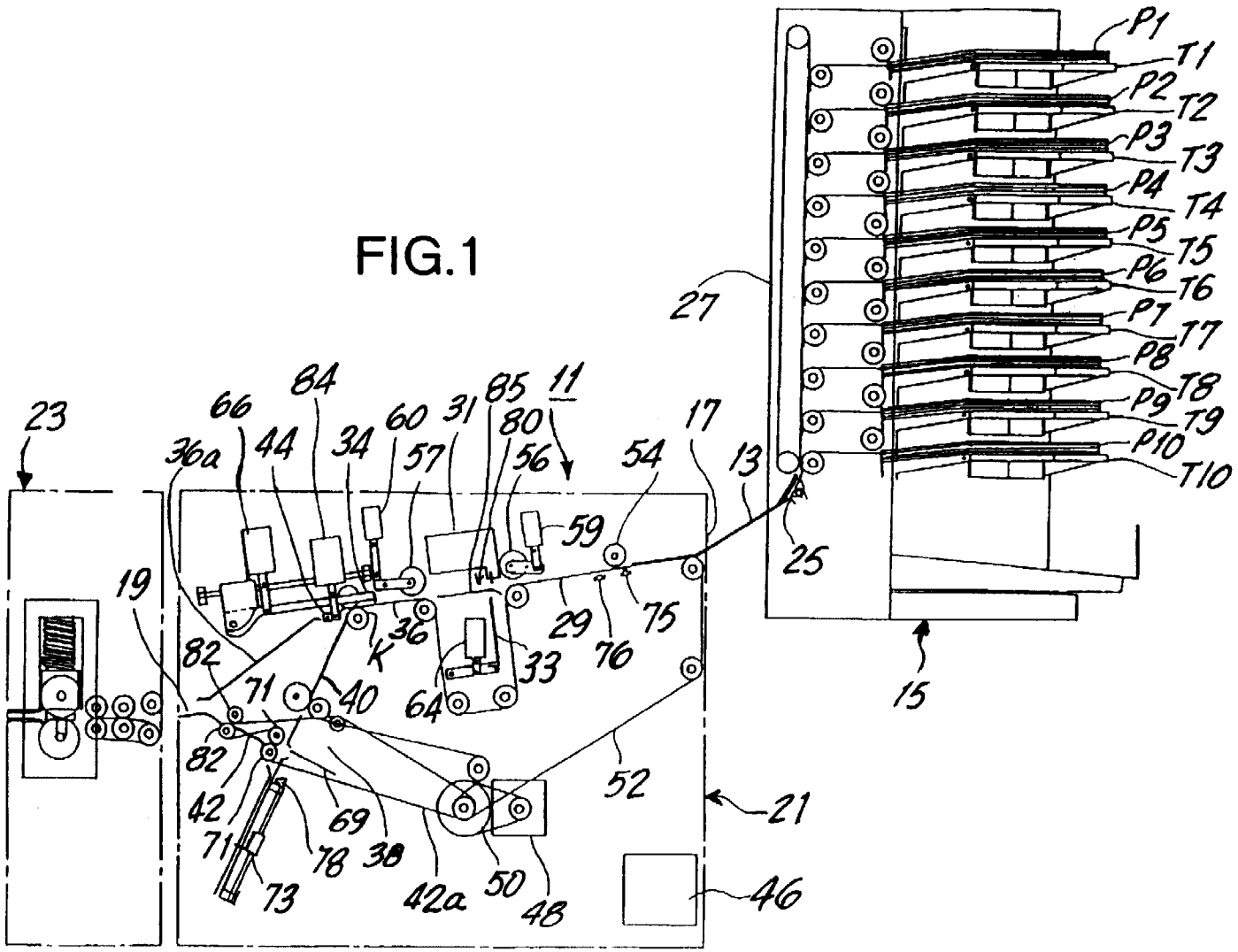
FIG. 1 is a sectional side view illustrating a configuration of a sheet collating and stitching system including a sheet stitching apparatus in accordance the present invention.
Figure 2:
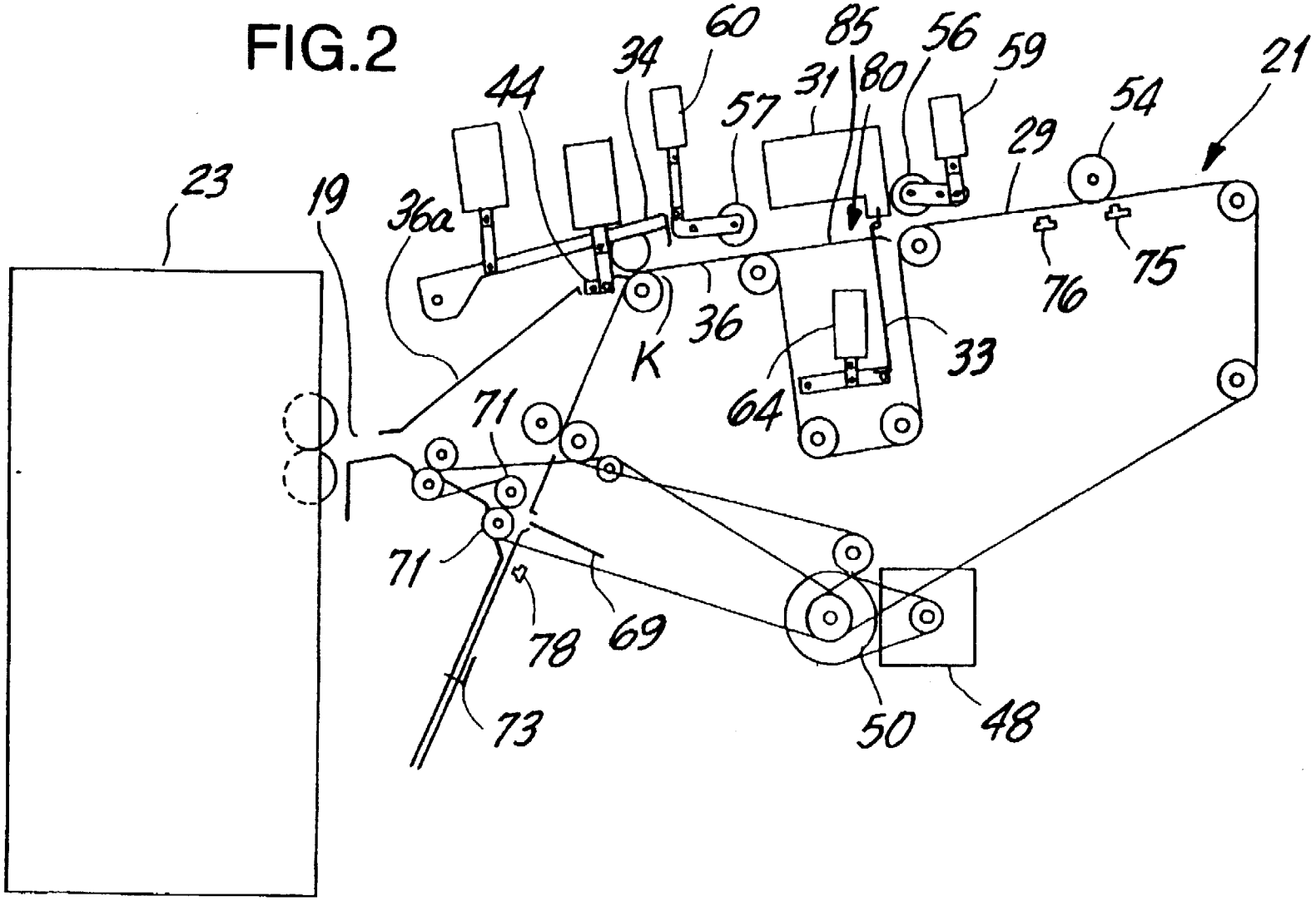
FIG. 2 is a sectional side view of the stitching apparatus shown in FIG. 1, illustrating the situation in which the stitching apparatus stitches a set of collated sheets along an end line thereof or at a corner thereof.
Figure 3:
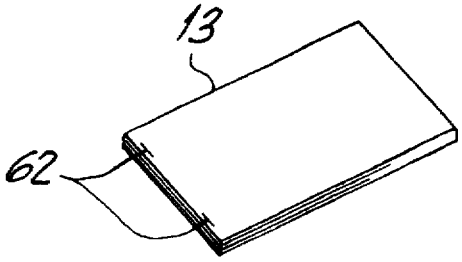
FIG. 3 is a perspective view of sheet set stitched along the end line thereof.
Figure 4:
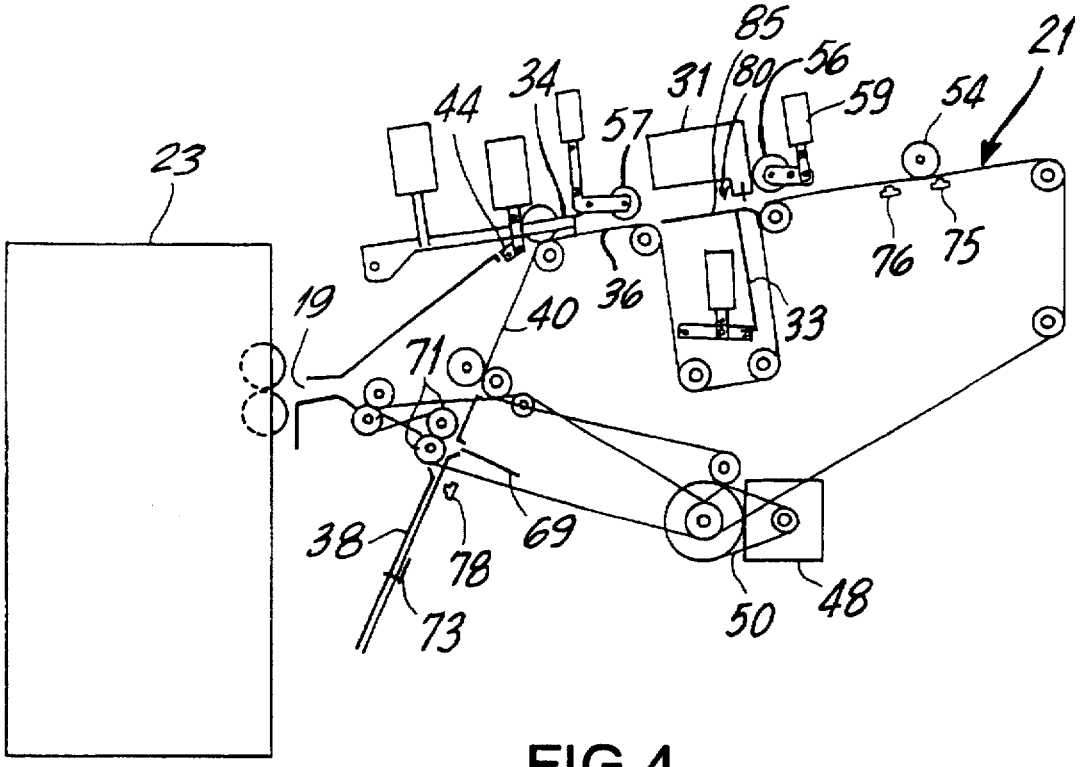
FIG. 4 is a sectional side view of the stitching apparatus shown in FIG. 1, illustrating the situation in which the stitching apparatus stitches a set of collated sheets along the center line thereof and then bends the stitched sheet set double.
Figure 5:
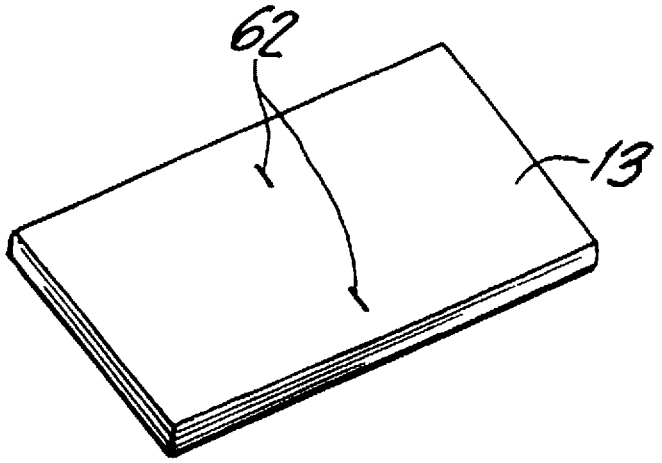
FIG. 5 is a perspective view of sheet set stitched along the center line thereof.

FIG. 1 is a sectional side view illustrating a configuration of a sheet collating and stitching system including a sheet stitching apparatus in accordance the present invention, FIG. 2 is a sectional side view of the stitching apparatus shown in FIG. 1, illustrating the situation in which the stitching apparatus stitches a set of collated sheets along an end line thereof or at a corner thereof and FIG. 4 is a sectional side view of the stitching apparatus shown in FIG. 1, illustrating the situation in which the stitching apparatus stitches a set of collated sheets along the center line thereof and then bends the stitched sheet set double. FIG. 3 is a perspective view of sheet set stitched along the end line thereof and FIG. 5 is a perspective view of sheet set stitched along the center line thereof.

Referring to FIGS. 1, 2 and 4, a sheet collating and stitching system 11 includes a sheet collator 15. The sheet collator 15 is coupled to a sheet supply inlet 17 of a stitching apparatus 21 in accordance with the invention. The stitching apparatus 21 is arranged for receiving collated sheets 13 from the sheet collator 15 and stitching the collated sheets 13 along the center line thereof and then bending the stitched sheets double along the stitched portion thereof. A post-processing apparatus 23 is coupled to a sheet eject outlet 19 of the stitching apparatus 21 so as to receive stitched sheet set from the stitching apparatus 21 and complete a stitched product of sheets.

As is generally known, the sheet collator 15 is provided with a plurality of sheet supply shelves T1–T10 which are arranged parallelly with each other in a vertical direction. Sheets P1 each of which composes first page are placed on the shelf T1, and sheets P2 each of which composes second page are placed on the shelf T2,—and sheets P10 each of which composes tenth page are placed on the shelf T10. The sheet collator 15 is further provided with a sheet feeding mechanism 27 which sequentially transports single sheets from the respective shelves T1–T10 onto a sheet delivery tray 15 so as to form a set of collated sheets 13 on the tray 15. The sheet delivery tray 15 is connected with the sheet supply inlet 17 of the stitching apparatus 21.

The stitching apparatus 21 includes a sheet stitching station 80 and a sheet bending station 38 therein. In the sheet stitching station 80, a stitching head 31, a first stopper 33 for a set of collated sheets 13 to be stitched along an end line or at a corner thereof and a second stopper 34 for a set of collated sheets 13 to be stitched along an center line thereof are installed. In the sheet bending station, a third stopper 73, a fold knife 69 and a pair of fold rollers 71, 71 are installed. The stitching apparatus 21 further includes a transport path for transporting sheet sets 13 from the sheet supply inlet 17 to the sheet eject outlet 19.

The sheet transport path is partially constructed by a conveyor belt loop 52. Thus the transport path comprises a first transport path portion 29 composed of a conveyor belt loop portion extending from the sheet supply inlet 17 to the stitching head 31, a chute 85 arranged between the stitching head 31 and the first stopper 33, a second transport path portion 36 composed of a conveyor belt loop portion extending from the chute 85, beyond the second stopper 34, to a branch (K), a third transport path portion 40 composed of a conveyor belt loop portion downwardly sloping from the branch (K) to the sheet bending station 38, a fourth transport path portion 42 formed between a pair of fold rollers 71 , 71 and a pair of delivery rollers 82, 82, and an inclined guide plate **36*a* extending from the branch (K) to the sheet eject outlet 19. At the branch (K) , a switching gate plate 44** is arranged.

Thus the transport path for transporting sheet sets 13 from the sheet supply inlet 17 to the sheet eject outlet 19 substantially linearly extends from the sheet supply inlet 17 to the branch (K), and, at the branch (K), is divided into two transport paths which slope downwardly from the branch (K) at different angles, respectively. The two transport paths are connected with each other at their forward ends (through the fourth transport path portion 42). In other words, a stitched sheet set 13 bent along its center line is transported to the sheet eject outlet 19 along one of the two transport paths, while a stitched sheet set 13 not bent is transported to the sheet eject outlet 19 along the other of the two transport paths, so that it is possible to eject the sheet sets stitched in different stitching patterns from a single sheet eject outlet 19.

The above-mentioned conveyor belt loop 52, which forms the first, second and third transport path portions 29, 36 and 40, is driven by a motor 48 through a reduction pulley 50. The fold roller pair 71 , 71 and the delivery roller pair 82, 82 are also driven by the motor 38 through the reduction pulley 50 and a belt **42*a*. Thus a drive source of a sheet transport mechanism of the stitching apparatus is composed of a single motor 48**, which contributed to the simplification of control, and the reduction of manufacturing cost and installing space.

A feed roller 54 is positioned on the first transport path portion 29 in the neighborhood of the sheet supply inlet 17 and pressed against the conveyor belt 52 in such a manner that collated sheets 13 is nipped between the feed roller 54 and the conveyor belt 52 and supplied into the stitching apparatus 21. In the neighborhood of the feed roller 54, two sheet detection sensors 75, 76 are arranged with a distance therebetween. The position of each of these sensors 75, 76 are adjustable along the sheet transport direction.

The sheet detection sensors 75, 76 detect the position of a supplied sheet set and when the rear end of the sheet set is positioned between the sheet detection sensors 75, 76, the sheet position is determined to be normal. Then based on signals from the sheet detection sensors 75, 76, when the sheet position is normal, the transport operation by the conveyor belt 52 is stopped.

On the rear end of the first transport path portion 29 and on the front end of the second transport path portion 36, that is, on both ends of the chute 85, press pulleys 56, 57 are arranged, respectively so as to press collated sheets against the conveyor belt 52. These pulleys 56, 57 are supported by solenoids 59, 60 in such a manner that the pulleys can be pressed toward and retracted from the conveyor belt 52. When collated sheets are transported, they are pressed toward the conveyor belt 52 by the pulleys 56, 57, so that the sheet transport operation is performed.

The stitching head 31 is disposed above the chute 85 and as shown in FIGS. 3 and 5, operative to stitch collated sheets 13 together through wire 62.

The first stopper 33 and the stitching head 31 are arranged opposite sides of the chute 85. The first stopper 33 is supported by the solenoid 64 in such a manner that the first stopper 33 can be pressed toward and retracted from the transport path. Then the first stopper 33 protrudes its front end onto the transport path on performing the end line stitching or the corner stitching, as shown in FIG. 2, so that collated sheets 13 which are fed into the stitching apparatus along from the first transport path portion 29 are stopped by the first stopper 33 at a first position where the collated sheets can be stitched by the stitching head 31 along the end line (cf. FIG. 3) or at the corner thereof.

The first stopper 33 are disposed adjacent the stitching head 31 and the conveyor belt 52 goes around the first stopper 33. Between the first stopper 33 and the stitching head therefore, no conveyor belt 52 is arranged. The chute 85 serves ss the transport path between the first stopper 33 and the stitching head 31. When collated sheets 13 pass along the chute 85, the collated sheets 13 are pressed toward the conveyor belt 52 by the pulleys 56, 57 so ss to be guaranteed the smooth transport of the collated sheets.

The second stopper 34 is supported by a solenoid 56 in such a manner that the second stopper 34 can be pressed toward and retracted from the transport path. Then the second stopper 34 protrudes its front end onto the transport path, as shown in FIG. 4, so that the collated sheets 13 supported on the first and second transport path portions 19 and 26 are stopped by the second stopper 34 at a second position where the collated sheets can be stitched by the stitching head 31 along the center line thereof (cf. FIG. 5).

The first and second stoppers 33 and 34 are alternatively operated.

The switching gate plate 44 is arranged beyond the second stopper 34. The switching gate plate 44 is actuated by a solenoid 84 in such a manner that the switching gate plate 44 selectively connects the second transport path portion 36 to the third transport path portion or the inclined guide plate 36*a*.

When collated sheets 13 are stitched along the end line or at the corner thereof, the switching gate plate 44 is operable to connect the second transport path portion 36 to the inclined guide plate 36*a*, as shown in FIG. 2, and the stitched sheets 13 fall down to the sheet eject outlet 19 through the inclined guide plate 36*a*.

When collated sheets 13 are stitched along the center line thereof, the switching gate plate 44 is operable to connect the second transport path portion 36 to the third transport path portion 40, as shown in FIG. 4. After the transport along the third transport path portion, the stitched sheets 13 falls down from the third transport path portion 40 to the third stopper 73 of the sheet bending station 38.

The sheet bending station 38 is positioned on the extension of the third transport path portion 40. In the sheet bending station 38, the fold knife 69 is arranged for folding the stitched sheets along the stitched center line thereof by projecting from the plane on which stitched sheets are positioned. In addition, the pair of fold rollers 71, 71 are arranged oppositely to the fold knife 69 with respect to the stitched sheets. Thus the stitched sheets are pushed out by the fold knife 69 to a clearance between the fold roller pair 71, 71 and folded double along the center line thereof.

Furthermore, the sheet bending station 38 is provided with the third stopper 73 for controlling the position of an edge of stitched sheets and a sheet detection sensor 78 for detecting stitched sheets 13 supplied in the sheet bending station 38. The position of the third stopper 73 is adjustable according to the size of stitching sheets.

The stitched sheets 13 bent double along the center line thereof in the sheet bending station 38 are transported to the sheet eject outlet 19 through the fold roller pair 71, 71 and the delivery roller pair 82, 82.

A control circuit 46 receives detection signals from the sheet detection sensors 75, 76 and 78 so as to control the movement of each of the solenoids 59, 60, 64, 66 and 84 and the movement of the fold knife 69, and the movement of the motor In this embodiment, the post-processing apparatus 23 comprises a press machine for further pressing and fixing the crease of sheet set which has been stitched and bent, but instead of the press machine, other machines such as a trimming machine etc. can be employed.

In the stitching apparatus 21 according to the invention, the sheet supply inlet 17, the first and second transport path portions 29 and 36, and the stitching head 31 and the sheet eject outlet 19 and so on are employed in common at all of the end line stitching process and the corner stitching process and the center line stitching process.

As shown in FIG. 2, when collated sheets are stitched along the end line or at the corner thereof, the first stopper 33 projects its front end portion on the transport path and the switching gate plate 44 is actuated by the solenoid 84 so as to connect the second transport path portion 36 to the inclined guide plate 36*a*. Then collated sheets 13 fed into the sheet supply inlet 17 are stitched together by the stitching head 31 at the position controlled by the first stopper 33, and consequently, the end line stitching is completed as shown in FIG. 3. Thereafter, the first stopper 33 retracts from the transport path and the transport operation by the conveyor belt 52 is started again, and so the stitched sheets 13 are transported to the sheet eject outlet 19 through the second transport path portion 36 and inclined guide plate 36*a* and then delivered to the post-processing apparatus 23.

As shown in FIG. 4, when collated sheets are stitched along the center line thereof, the second stopper 34 projects its front end portion on the transport path and the switching gate plate 44 is actuated by the solenoid 84 so as to connect the second transport path portion 36 to the third transport path portion 40. Then collated sheets 13 fed into the sheet supply inlet 17 are stitched together by the stitching head 31 at the position controlled by the second stopper 34, so that the center line stitching is completed as shown in FIG. 5.

Thereafter, the second stopper 34 retracts from the transport path and the transport operation by the conveyor belt 52 is started again, and so the stitched sheets 13 are transported to the sheet bending station 38 through the third transport path portion 40.

Figure 6:
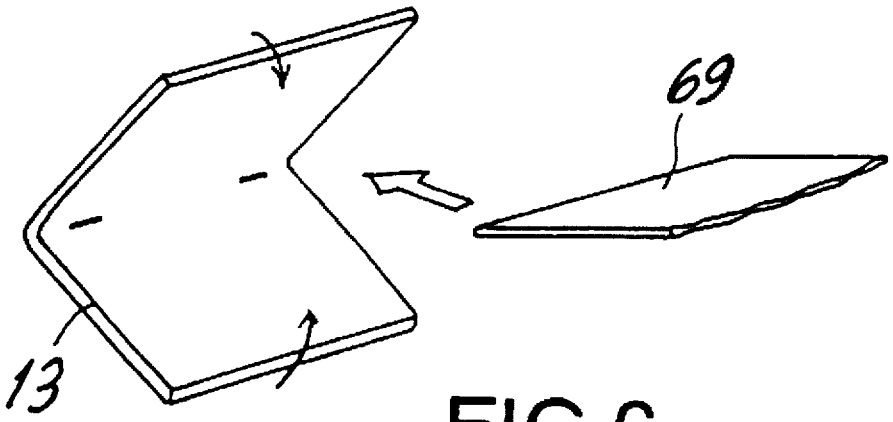
FIG. 6 is a perspective view of the sheet set shown in FIG. 5, in which the sheet set is bent by a fold knife along the stitched portion.

FIG. 6 is a perspective view of the sheet set in FIG. 5, in which the sheet set is bent by the fold knife 69 along the stitched portion, that is, the center line thereof. Referring to FIG. 6, when the sheet detection sensor 78 detects stitched sheets 13, the fold knife 69 presses its frond end against the center line of the stitched sheets and then the stitched sheets which have been bent double by the fold knife 69 are drew between the pair of fold rollers 71, 71, so that the stitched sheets 13 are definitely bent double along its center line, thereafter transported to the sheet eject outlet 19 and then delivered to the post-processing apparatus 23.

According to this embodiment, the transport path is divided into the first transport path portion 29 composed of the conveyor belt extending from the sheet supply inlet 17 to the stitching head 31, the chute 85 arranged between the stitching head 31 and the first stopper 33, the second transport path portion 36 composed of the conveyor belt portion extending from the chute 85, beyond the second stopper 34, to the branch (K). However, a transport path section extending from the first transport path portion 29 to the second transport path portion 36 can be composed of a single continuous conveyor belt, because this transport path section is only used for positioning collated sheets according to stitching patterns.

According to the present invention, it is facilitated to connect a post-processing apparatus such as a trimming machine to a sheet collating and stitching system by dividing a transport path for stitched sheets into two transport path sections, one of which extends to a sheet eject outlet, the other of which extends to a sheet bending station, at a branch and arranging a switching gate plate at the branch so as to switch the transport path sections depending on whether the bending operation is required or not, forming a transport path section which extends from the sheet bending station to the sheet eject outlet, so that the system is provided with only one sheet eject outlet.

Furthermore, in another embodiment of this invention, the sheet eject outlet is disposed lower than the branch for switching the transport path sections, and the second and third transport path portions comprise a chute for gravitationally transporting stitched sheets and the first and fourth transport path portions comprise a conveyor belt loop driven by a single drive source. According to this embodiment, a simple and compact stitching apparatus can be achieved.

While the presently preferred embodiments of the present invention have been shown and described, it is to be understood these disclosures are for the purpose of illustration and that various changes and modifications may be made without departing from the scope of the invention as set forth in the appended claims.

What is claimed is:

1. An apparatus for stitching collated sheets, said apparatus receiving a set of collated sheets (13) at a sheet supply inlet (17) thereof, transporting the collated sheets (13) to a sheet stitching station (80), stitching the collated sheets (13) along the center line thereof or along an end line or at a corner thereof by means of a stitching head (31) disposed at the sheet stitching station (80), and delivering the sheets stitched along the end line or at the corner thereof from at least one sheet eject outlet thereof, while delivering the sheets stitched along the center line thereof from at least one sheet eject outlet after transport to a sheet bending station (38) so as to bend the stitched sheets double along the center line, characterized in that said apparatus comprises:

a first transport path portion (29) for transporting the collated sheets (13) from said sheet supply inlet (17) to said sheet stitching station (80);

a first stopper (33) arranged at said sheet stitching station (80) for positioning the sheets to be stitched along the end line or at the corner thereof;

a second stopper (34) arranged at said sheet stitching station (80) for positioning the sheets to be stitched along the center line thereof;

a second transport path portion (36) for transporting the stitched sheets from said sheet stitching station (80) to a branch (K);

a fifth transport path portion for transporting the stitched sheets from said branch (K) to a sheet eject outlet (19);

a third transport path portion (40) for transporting the stitched sheets from said branch (K) to said sheet bending station (38);

a switching gate plate (44) arranged at said branch (K) for selectively connecting said second transport path portion (36) to said third transport path portion (40) or said fifth transport path portion;

a third stopper (73) arranged at said sheet bending station (38) for positioning the sheets stitched along the center line thereof;

sheet bend means arranged at said sheet bending station (38) for bending the stitched sheets double along the center line thereof; and a fourth transport path portion (42) for transporting the stitched sheets bent double from said sheet bending station (38) to said sheet eject outlet (19).

2. The apparatus for stitching collated sheets in accordance with claim 1, characterized in that said first transport path portion (29), said second transport path portion (36) and said third transport path portion (40) are composed of a part of a single conveyor belt loop (52), respectively and that a chute (85) is disposed between said stitching head (31) and said first stopper (33), and that said fourth transport path portion (42) is composed of a clearance of a pair of fold rollers (71), (71) and a clearance of a pair of delivery rollers (82), (82) and a space between the fold roller pair and the delivery roller pair, and that said fifth transport path portion is composed of an inclined guide plate (**36*a*) downwardly extending from said branch (K) to said sheet eject outlet (19**).

3. The apparatus for stitching collated sheets in accordance with claim 1, characterized in that said sheet eject outlet is disposed lower than said branch (K), and that said second and third transport path portions (36) and (40) comprise a chute for gravitationally transporting stitched sheets, respectively and said first and fourth transport path portions (29) and (42) comprise a part of a single conveyor belt loop driven by a single drive source, respectively and that said fifth transport path portion is composed of an inclined guide plate (**36*a*) downwardly extending from said branch (K) to said sheet eject outlet (19**).

4. The apparatus for stitching collated sheets in accordance with any one of claims 1 to 3, characterized in that said sheet bend means comprises said pair of fold rollers (71), (71) and a fold knife (69) arranged oppositely to said fold roller pair with respect to the stitched sheets in such a manner that said fold knife (69) projects its tip portion from the plane on which the stitched sheets are positioned.

* * * * *